US009053687B1

(12) United States Patent
Benson

(10) Patent No.: US 9,053,687 B1
(45) Date of Patent: Jun. 9, 2015

(54) DRUM RESTRAINT DEVICE

(71) Applicant: Gary Benson, Novato, CA (US)

(72) Inventor: Gary Benson, Novato, CA (US)

( * ) Notice: Subject to any disclaimer, the term of this patent is extended or adjusted under 35 U.S.C. 154(b) by 0 days.

(21) Appl. No.: 14/199,688

(22) Filed: Mar. 6, 2014

Related U.S. Application Data

(60) Provisional application No. 61/773,307, filed on Mar. 6, 2013.

(51) Int. Cl.
*G10D 13/00* (2006.01)
*G10D 13/02* (2006.01)
*G10G 5/00* (2006.01)

(52) U.S. Cl.
CPC ..... *G10G 5/005* (2013.01); *G10D 13/026* (2013.01); *G10D 13/006* (2013.01); *G10G 5/00* (2013.01); *G10D 13/02* (2013.01); *G10D 13/00* (2013.01)

(58) Field of Classification Search
CPC ..... G10D 13/00; G10D 13/02; G10D 13/006; G10G 5/00
USPC ..... 84/421, 422.1
See application file for complete search history.

(56) References Cited

U.S. PATENT DOCUMENTS

| | | | | | |
|---|---|---|---|---|---|
| 516,612 | A * | 3/1894 | Rappold | 84/422.2 |
| 1,288,179 | A * | 12/1918 | Poehland | 84/280 |
| 2,367,052 | A * | 1/1945 | Rentie | 84/170 |
| 2,505,882 | A * | 5/1950 | Cassato | 84/421 |
| 3,096,677 | A | 7/1963 | Ryan | |
| 3,543,632 | A * | 12/1970 | Flame | 84/453 |
| 3,710,670 | A * | 1/1973 | Winkler | 84/421 |
| 4,832,302 | A * | 5/1989 | Anderson et al. | 248/443 |
| 5,677,502 | A * | 10/1997 | Laido | 84/421 |
| 5,990,401 | A * | 11/1999 | Braun et al. | 84/422.1 |
| 6,063,993 | A * | 5/2000 | Hoshino | 84/422.1 |
| 6,794,565 | B2 * | 9/2004 | Green | 84/421 |
| 7,128,368 | B2 * | 10/2006 | Sligh | 297/186 |
| 7,608,771 | B2 * | 10/2009 | Fournier et al. | 84/422.1 |
| 7,645,928 | B2 * | 1/2010 | Graham et al. | 84/421 |
| 8,022,282 | B1 * | 9/2011 | Burns | 84/421 |
| 2003/0061930 | A1 * | 4/2003 | Green | 84/421 |
| 2005/0011340 | A1 * | 1/2005 | Green | 84/484 |
| 2005/0156090 | A1 * | 7/2005 | Drayton | 248/346.03 |
| 2007/0234875 | A1 * | 10/2007 | Fisher | 84/422.1 |
| 2007/0256538 | A1 * | 11/2007 | Parra | 84/422.1 |
| 2013/0086790 | A1 * | 4/2013 | Hyams | 29/428 |

FOREIGN PATENT DOCUMENTS

DE 102005054117 A1 6/2006

* cited by examiner

*Primary Examiner* — David Warren
*Assistant Examiner* — Christina Schreiber
(74) *Attorney, Agent, or Firm* — Edward S. Sherman

(57) ABSTRACT

A bass drum is precluded from progressive movement from the hammer or bass drum beater impact by a strap connecting it to the drummer's seat. The strap is preferably connected to the foot pedal by a coupling plate that is seated there under or forms part of the foot pedal base.

8 Claims, 10 Drawing Sheets

FIG. 2A
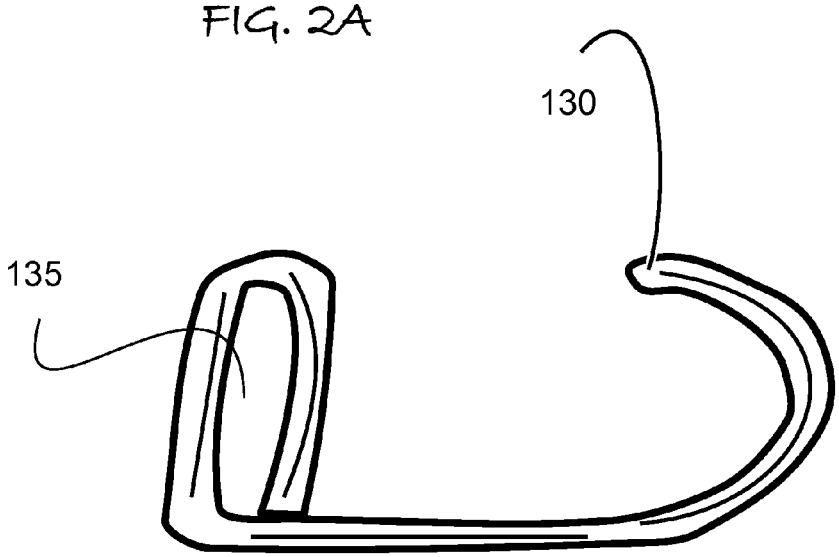
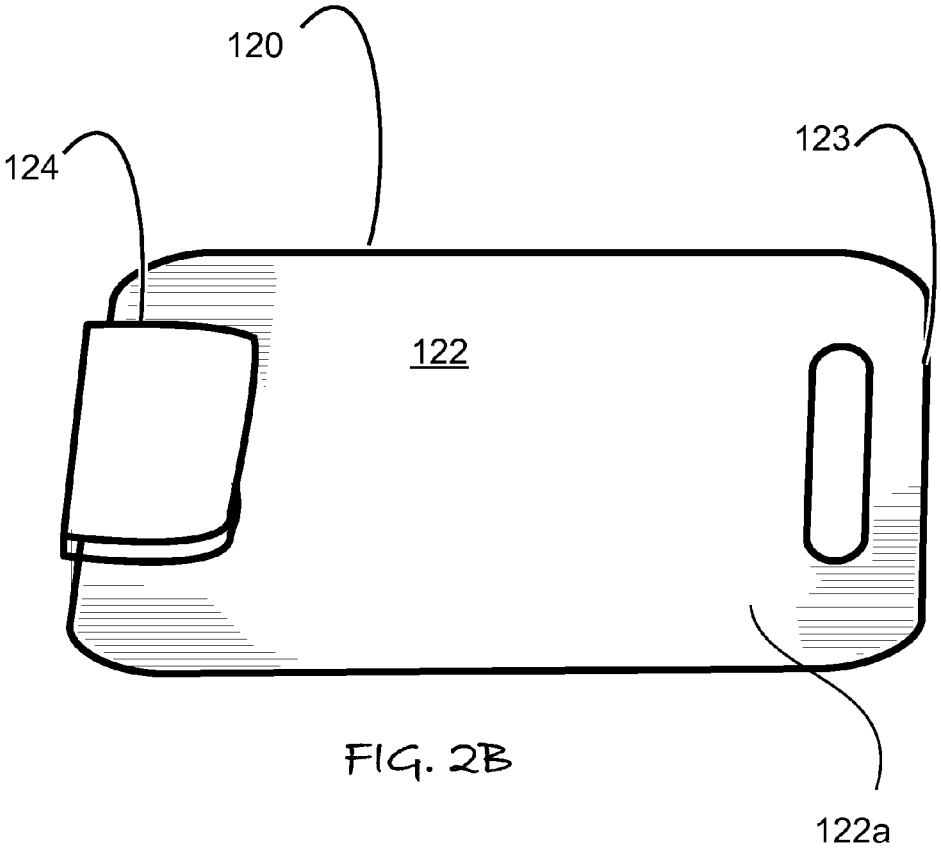
FIG. 2B

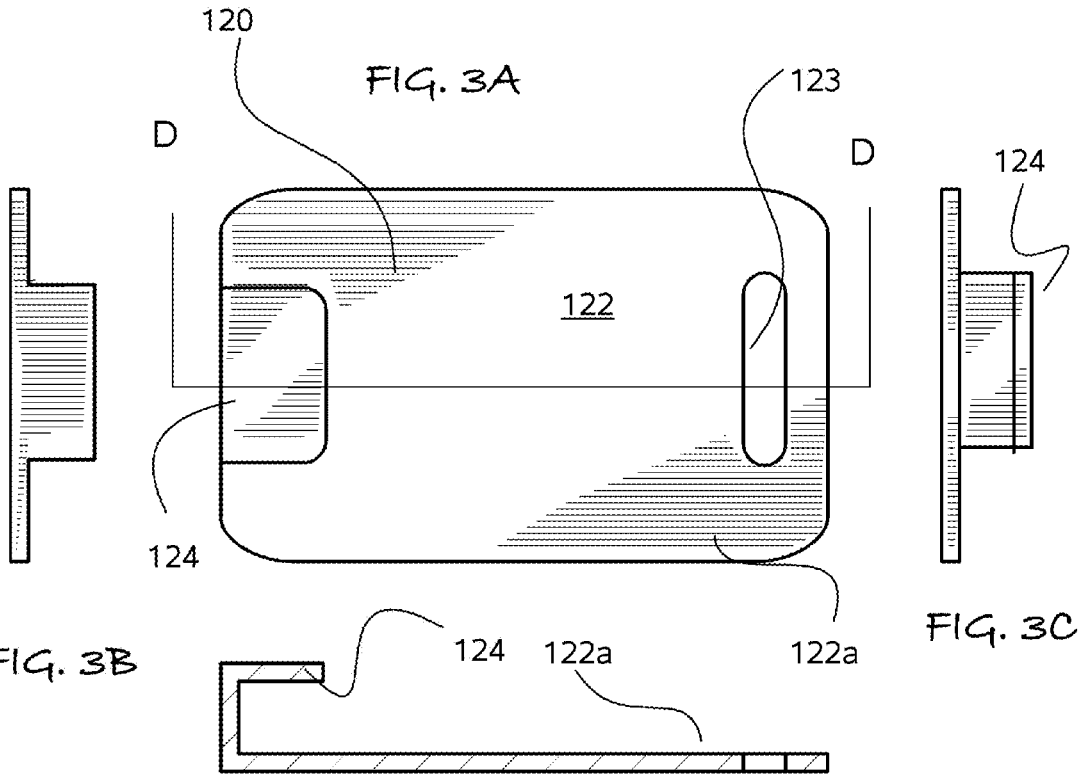
FIG. 3A
FIG. 3B
FIG. 3C
FIG. 3D
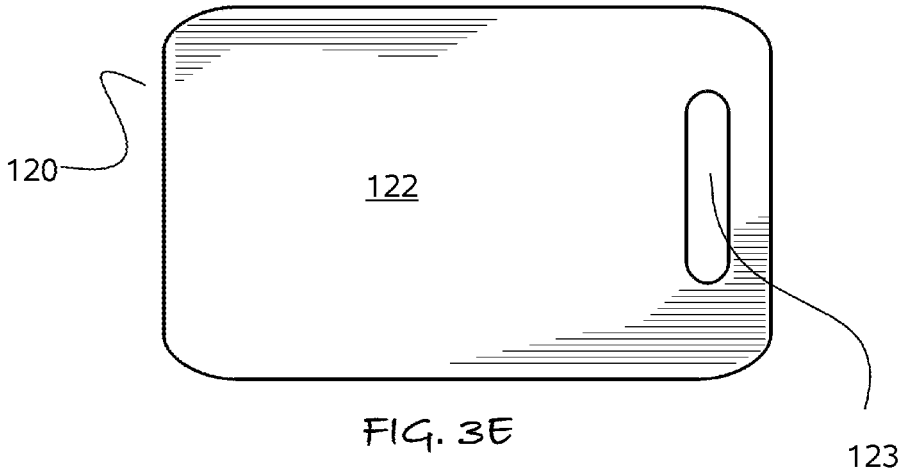
FIG. 3E

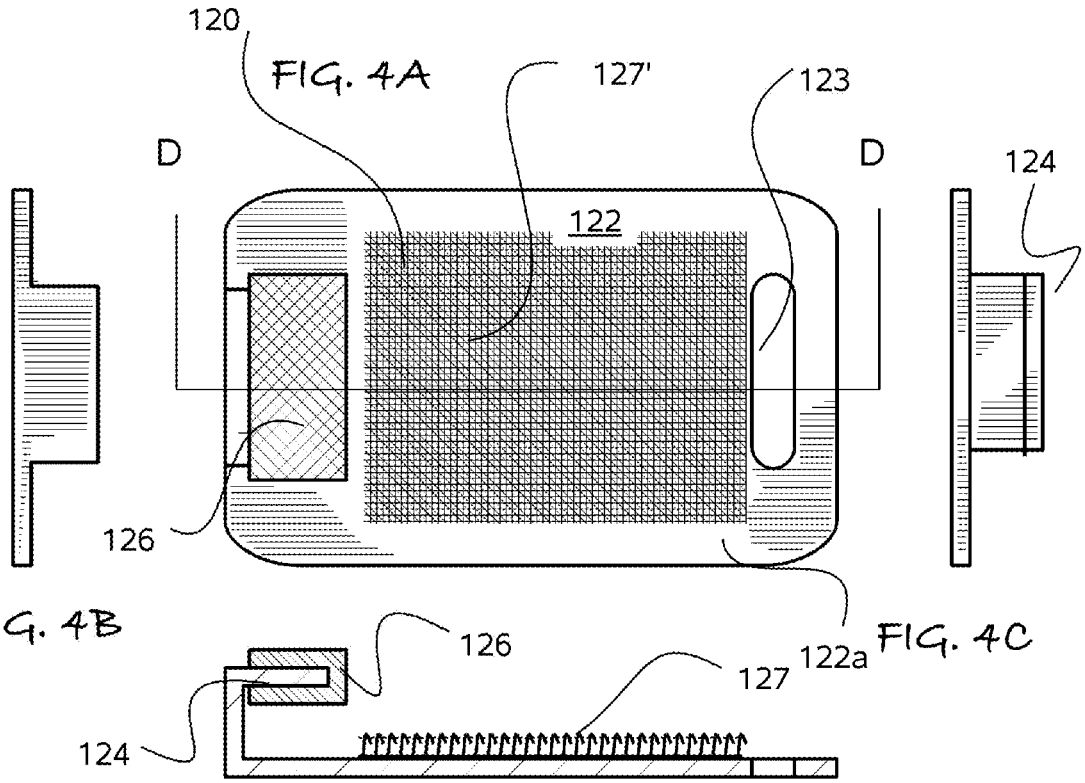
FIG. 4A
FIG. 4B
FIG. 4C
FIG. 4D
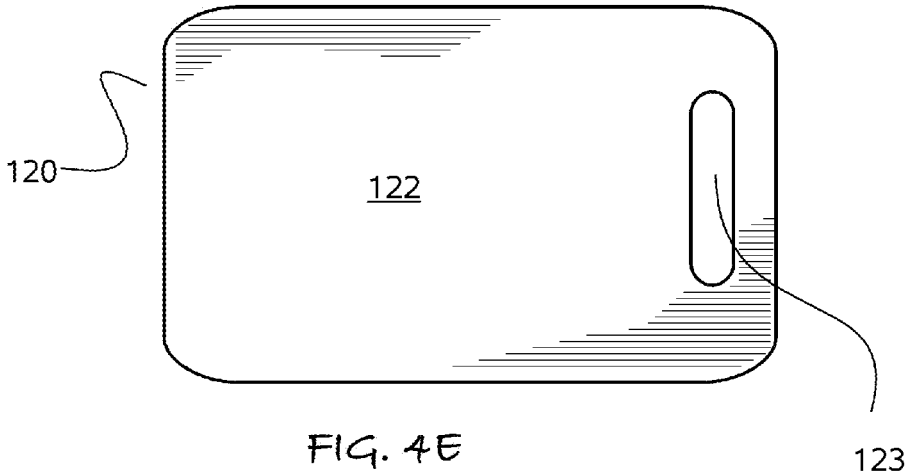
FIG. 4E

FIG. 9A
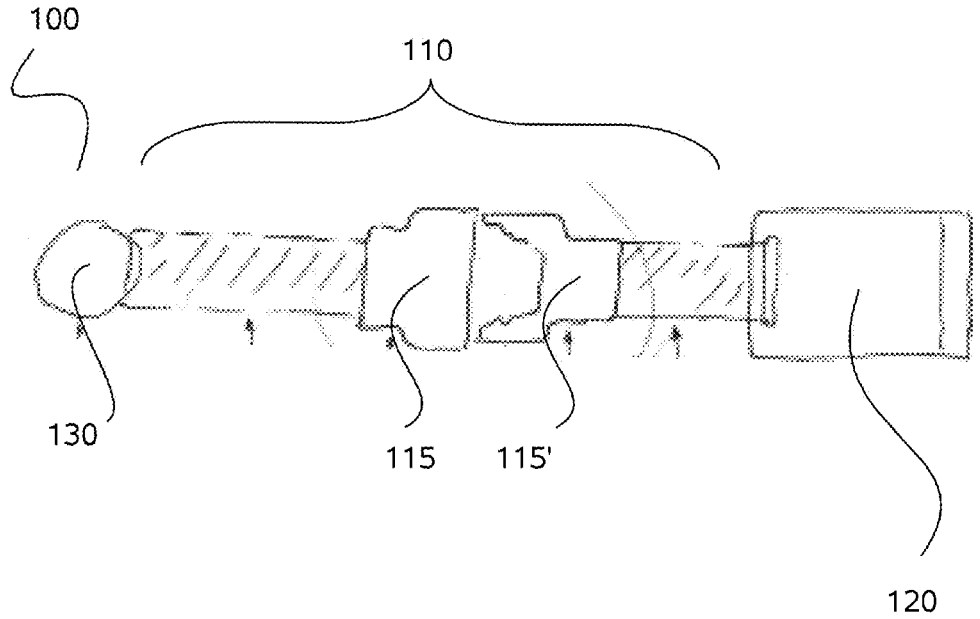
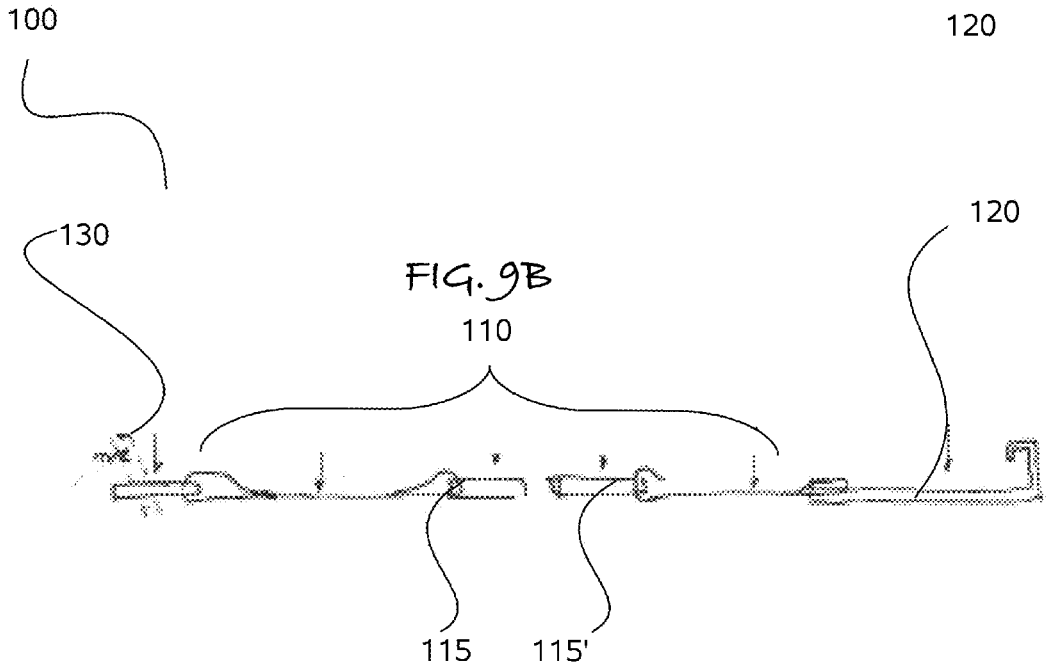
FIG. 9B

DRUM RESTRAINT DEVICE

CROSS REFERENCE TO RELATED APPLICATIONS

The present application claims the benefit of priority to the US Provisional Patent Application of the same title filed on Mar. 6, 2013, having application Ser. No. 61/773,307, which is incorporated herein by reference.

BACKGROUND OF INVENTION

The present invention relates to percussive musical instruments which may be called drum sets and include drums, cymbals, kick drums and bass drums, and more particularly to a restraint system that connects such instruments to the seat used by the instrument's player, the musician.

When percussive instruments are operated they tend to move away from the player. Drums and cymbal units, sometimes called high-hats, may be operated by foot pedals. The foot pedals are arranged at an angle to the floor and the resulting motion causes a force parallel to the floor and away from the player. The instruments therefore creep or travel away from the player. It is requisite to restrain the instruments against such motion and also to locate instruments where desired to meet the preferences of individual players. In other words, it is desirable to locate percussive or drum equipment universally.

Accordingly, it is an object of the present invention to provide an improved method of connecting a seat or chair to a bass drum, or drum assembly that includes a bass drum, and more particularly to effect such connection via the bass drum foot pedal.

It is another object of the present invention to provide anchoring devices which are universally adapted for anchoring and locating essentially all percussive instruments and their stands or legs supports.

It is a still further object of the present invention to provide improved anchoring devices for percussive musical instruments which may be assembled to the top of the player's rug and enables the player to locate percussive equipment to meet individual playing requirements.

SUMMARY OF INVENTION

In the present invention, the first object is achieved by providing a drum retaining apparatus comprising a strapping member having a proximal end and a distal end, a coupling plate for horizontal deployment and attachment to a bass drum rim that is connected to the proximal end of the strapping member, a coupler member attached to the distal end of the strapping member having a means for releasable attachment to at least one of a chair and stool.

Another object of invention is achieved by providing a process for restraining a bass drum, the process comprising the steps of providing the drum retaining apparatus described above, providing a bass drum foot pedal and a seat, attaching the coupling plate to the drum foot pedal wherein the planar portion is disposed below the drum foot pedal and another portion is secured to the drum foot pedal, securing the drum foot pedal to the seat via the strap member.

Another object of invention is achieved by providing drum pedal comprising a support plate, a pedal connected at a first end by a hinged joint to the support plate, a hammer connected to a second end of the pedal and biasing to swing in response to movement of the pedal, a strap member having a proximal end and a distal end opposite the proximal end, the proximal end connected to the support plate, and a seat coupler connected to the distal end of the strap member.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 1A is a perspective view of the coupling plate and strap portion of a preferred embodiment of the device, whereas

FIG. 2A is a plan view of an embodiment of the coupler hook in FIG. 1B, whereas FIG. 2B is a perspective view of the coupling plate, before connection to the strap member.

FIG. 3A is a top plan view of the coupling plate of FIGS. 1A and 2B, whereas FIG. 3B is a front elevation view thereof, FIG. 3C is a back elevation view thereof, and FIG. 3D is a side elevation view thereof and FIG. 3E is a bottom plan view thereof.

FIG. 4A is a top plan view of an alternative embodiment of the coupling plate, whereas FIG. 4B is a front elevation view thereof, FIG. 4C is a back elevation view thereof, and FIG. 4D is a side elevation view thereof and FIG. 4E is a bottom plan view thereof.

FIG. 5A is a top perspective view of a foot pedal for a base drum having the coupling plate of FIG. 4A-E attached thereto, whereas

FIGS. 9A and 9B respectively illustrated a top plan and side elevation view of an alternative embodiment of the device.

DETAILED DESCRIPTION

Figure 1A:
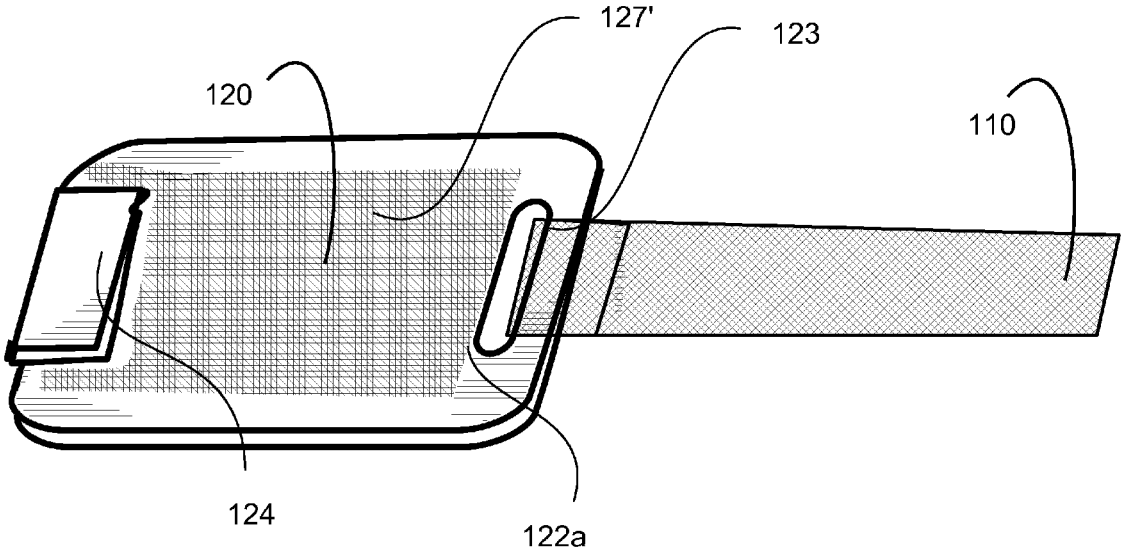
Figure 1B:
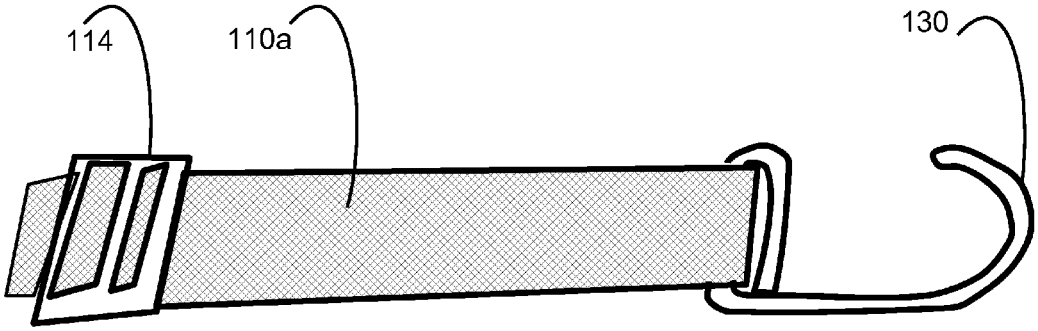
FIG. 1B is a perspective view of the opposite end of the strap that is connect to coupler intended for connection to a chair or stool.

Referring to FIGS. 1 through 10, wherein like reference numerals refer to like components in the various views, there is illustrated therein a new and improved Drum Restrain Device and method of use, the device generally denominated 100 herein.

In accordance with the present invention, the Drum Restrain Device 100 comprises a strap 110, a coupling plate 120, for direct or indirect connection to the bass drum 2 and foot pedal/hammer assembly 5, and a coupler 130 for connection to a seat 10.

The coupling plate 120 can be connected to another planar member supporting a pedal biased hammer (i.e. the convention foot pedal 5 with a planar base 20, in which the pedal biased hammer 21 pivots so the heads 22 strikes the taught drum skin 7 in response to the movement of the pedal 23. Strap 110 runs under the foot pedal assembly 21, 22 and 23, for connection to a chair 10. As the drummer is seated on the chair 10, they prevent the movement of the drum 2 when the hammer head 22 strikes the drum skin 7. Hence, the drum 2 need not be clamped to the floor or placed on a non-friction mat or other motion stop.

Figure 10:
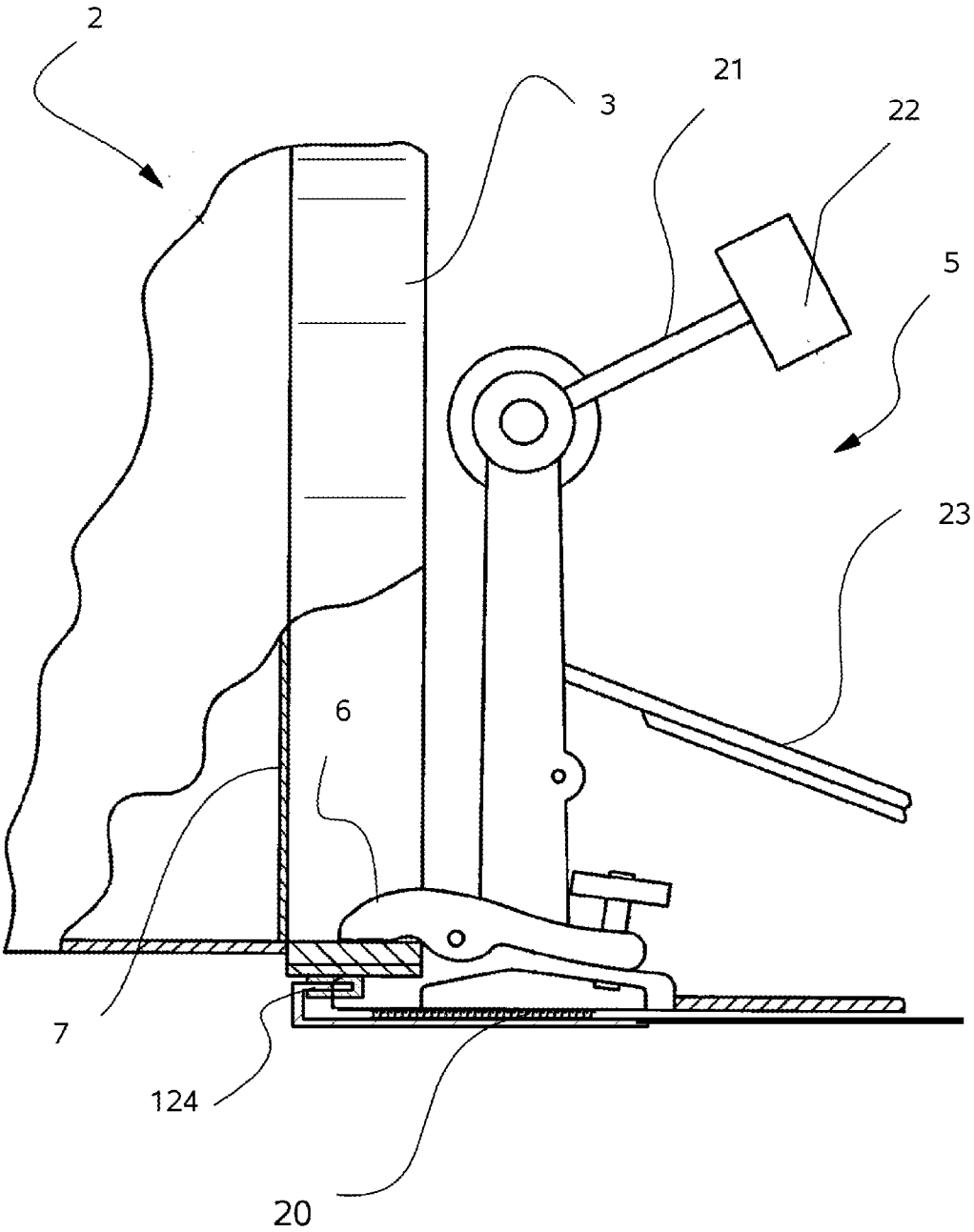
FIG. 10 is a partial sectional elevation of the foot pedal assembly connected to the drum rim and connecting plate.

In a preferred embodiment the coupling plate member 120 is a planar generally rectangular sheet of metal 122 having a slot 123 adjacent the distal end for connection to a strap 110 and a flat hook member 124 at the proximal end for clamping to the bass drum rim with the metal pedal device. The flat hook member 124 is preferably a U-shaped fold at the plate's proximal end, the fold bringing a planar appendage of the planar sheet parallel to, but spaced away from the larger portion coupling plate 120 defined by the planar sheet 122. The flat hook portion 124 of the coupling plate 120 is preferably clamped to drum rim 3 via the clamp 6 on the bass foot pedal 5, as shown in FIG. 10.

Strap 110 also preferably has an adjustable length retaining member 114 (FIG. 1B), which enables variation of the straps length by adjusting the position of the retaining member 114 on the strap 110, as the retaining member 114 by modulating the size of the loop portion of the strap 110*a* secured by retaining member 114.

The restraining device 100 is portable, and in a more preferred embodiment of FIG. 4, is attached to the foot pedal 5, so it is not misplaced, lost or forgotten. The embodiment of FIG. 4A-E also deploys a pair of hook and loop fasteners 127 and 127' with one of the pair on the top surface 122*a* of the coupling plate 120 for connection to the complimentary fastener of the pair on the bottom 20 of the foot pedal 5. The device 100 does not damage the floor or require floor modifications, and can be made at a low cost and is simple to install.

Figure 5A:
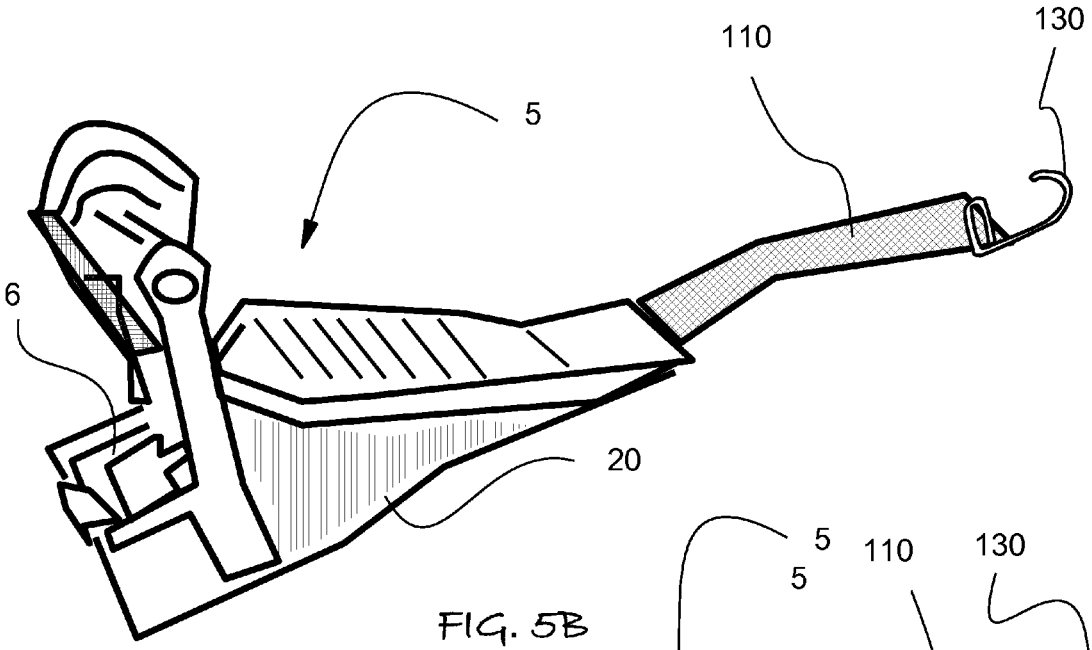
Figure 5B:
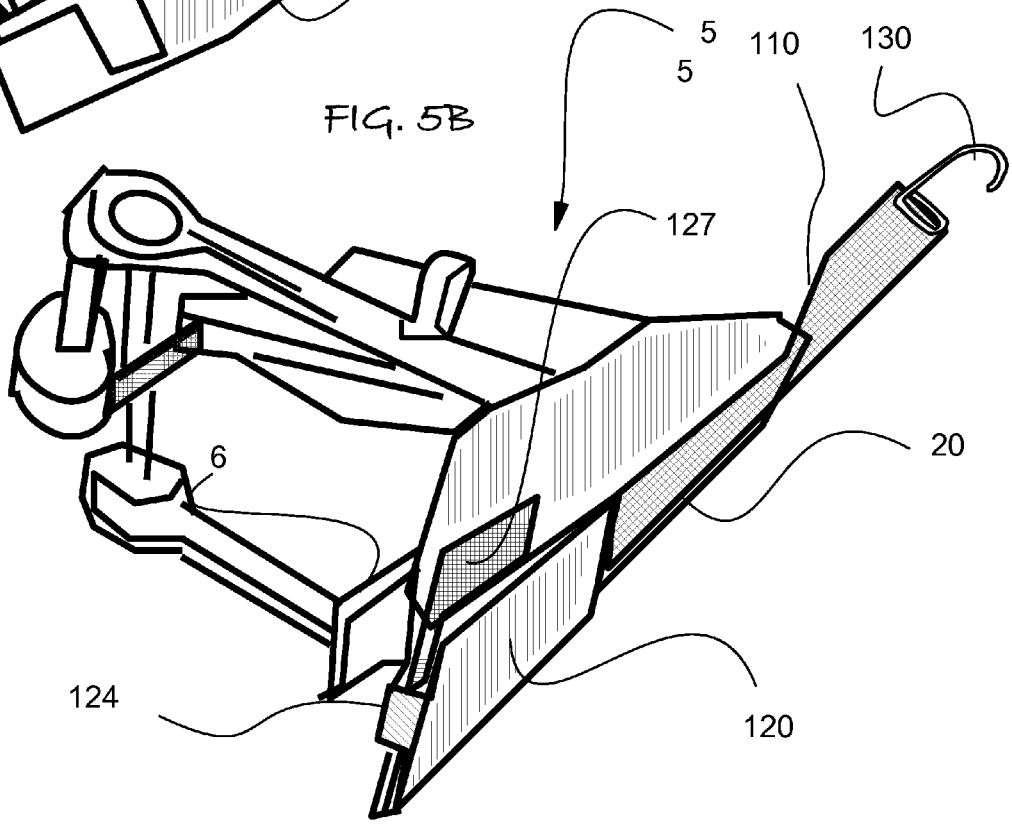
FIG. 5B is a bottom perspective view thereof.
Figure 6:
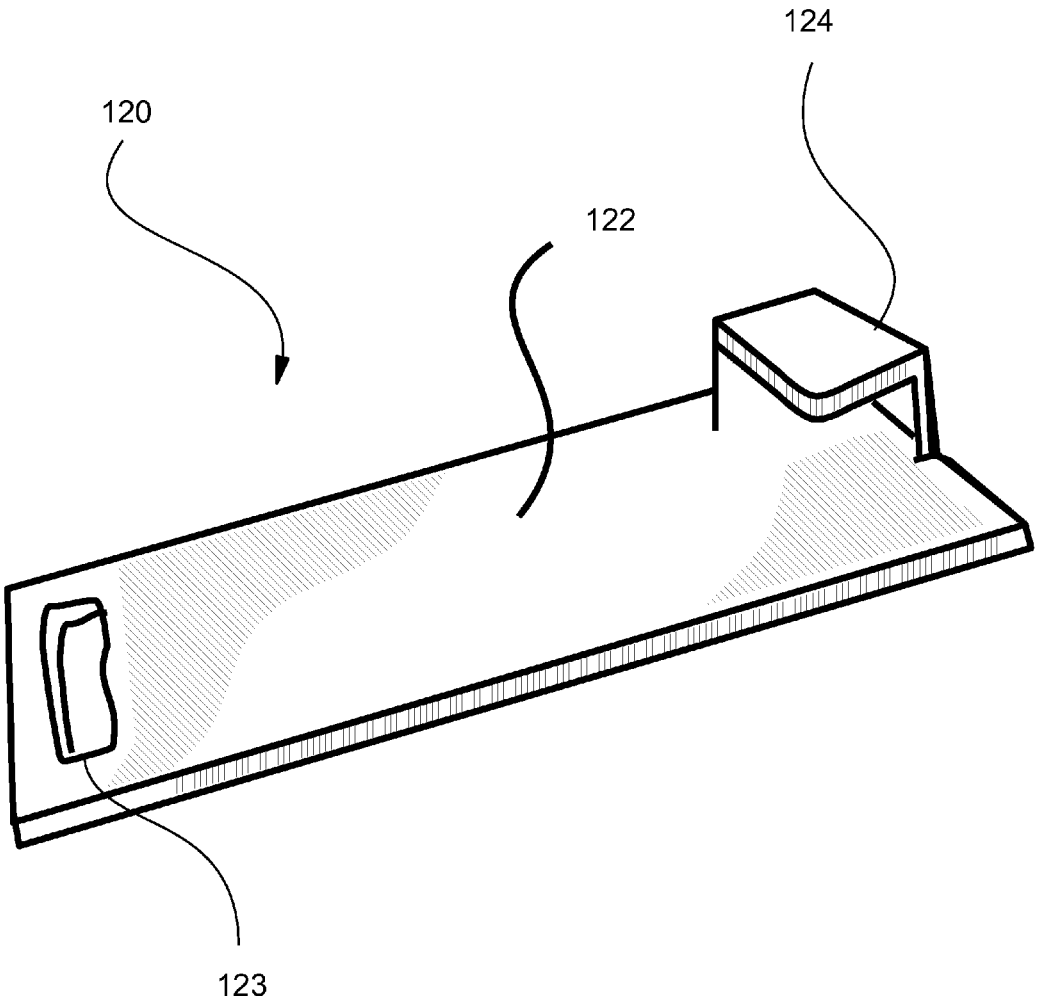
FIG. 6 is top perspective view of the coupling plate of FIG. 4A-E.
Figure 7:
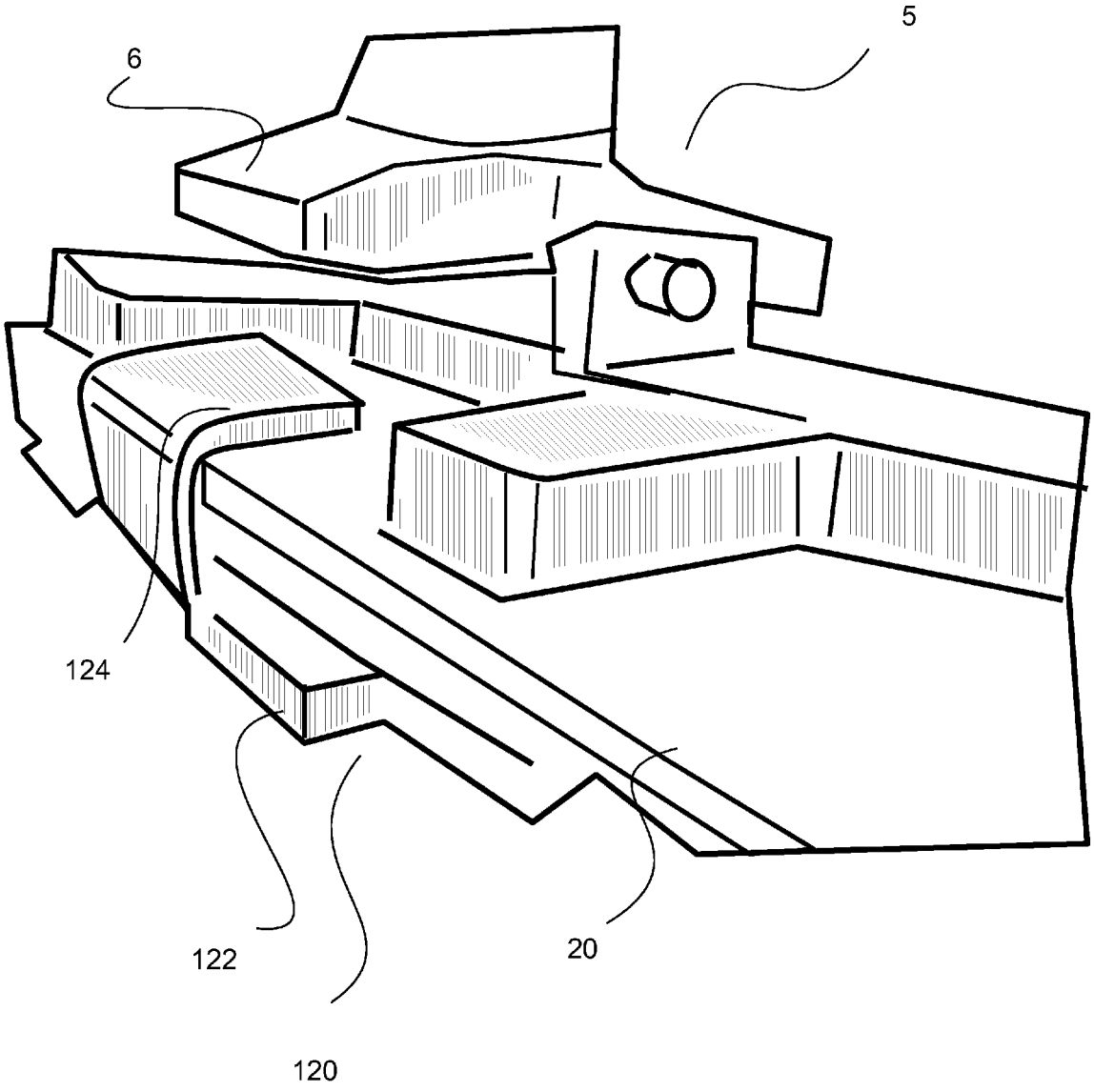
FIG. 7 is an enlarged portion of FIG. 5A showing the positioning of a portion of the coupling plate for clamped attachment between the bass drum rim and the foot pedal.
Figure 8:
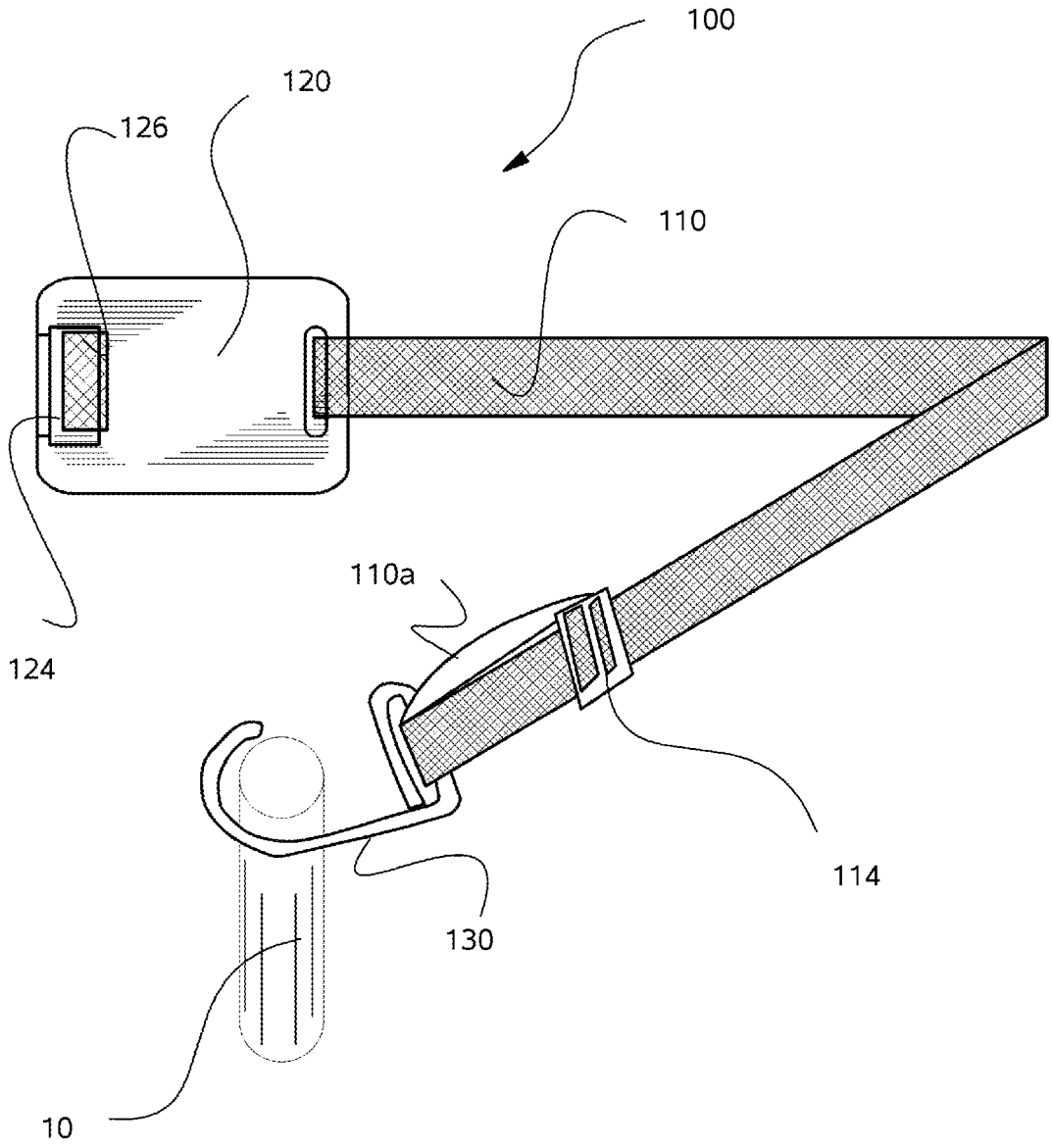
FIG. 8 is a top plan view illustrating the attachment of the device to a chair or stool leg or center post.

In a more preferred embodiment in FIG. 4A-E, there is also rubber padding 126 on the flat hook 124. The rubber padding 126 aids in the gripping the rim 3 of a bass drum 2 to a clamp 6 that is part of the foot pedal assembly 5, as shown in FIGS. 5A-B and 10.

The coupling plate 120 connection to the strap 110 is via a slot 123 in the planar base 122; the strap 110 extends through one side of the slot and then exits on the other side, extending backward to connect to itself, such as by durable stitching. The opposing end of the strap 110 is connected to a coupler structure 130, which is then connected to the chair or stool 10, and is optionally is a hook, ring or loop fastener for extending at least partially around a cylinder that forms either a leg or the seat support member, as in the center post of a stool. Preferably coupler 130 is the hook 130 shown in FIGS. 1B and 2A, having a slot 135 for receiving the connected end of the strap 110, in which the strap 110 extends through one side of the slot 135 and then exits on the other side, extending backward to connect to itself, such as by durable stitching.

Coupling plate 120 optionally directly supports a pedal biased hammer assembly, such as 21, 22 and 23 in FIG. 10, and includes slot 123 on base 20 to received strap 110 and connected seat coupler 130. The support plate 120 includes a pedal 23 connected at a first end by a hinged joint to the support plate 120, a hammer 21 terminating in head 22 is connected to a second end of the pedal and biased to swing in response to movement of the pedal 23. The drum rim 3 via the clamp 6.

As shown in FIGS. 9A and 9B, the strap 110 can be subdivided into two or more portions, which are optionally connected by a pair of mating males 115 and female 115' snap connectors.

Another aspect of the invention is the process of installing the device 100 for retaining a bass drum 2, or bass drum assembly, the process comprising the steps of providing the drum retaining apparatus 100, providing a bass drum foot pedal 5 and a seat 10, attaching the coupling plate 120 to the drum foot pedal 5 wherein the planar portion 122 is disposed below the drum foot pedal base 20 and another portion is secured to the drum foot pedal, securing the drum foot pedal to the seat via the strap.

As shown in FIG. 10, the bass drum foot pedal assembly 5 is preferably attached to the bass drum rim 3 via the clamp 6 that simultaneously engages the flat hook member 124 to secure the coupling plate 120 to the seat 10. More preferably, the hook and loop fasteners 127/127' secure the coupling 120 to the foot pedal base 20, when the foot pedal 23 is disengaged from the drum rim 3 for storage or transport.

Coupling plate 120 with attached strap 110 optionally directly supports a pedal biased hammer assembly, such as 21, 22 and 23 in FIG. 10, and includes slot 123 on base 20 to received strap 110 and connected seat coupler 130. The pedal 23 is connected at a first end by a hinged joint to the support plate 120, a hammer 21 terminating in head 22 is connected to the pedal hinge by a cable and biased to rotate or swing the hammer 21 in response to movement of the pedal 23 so that the head 22 strikes the drum skin 7.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A drum retaining apparatus comprising:

a) a strapping member having a proximal end and a distal end, b) a planar coupling plate having a flat hook member at a proximal end and a distal end opposing the proximal end, the distal end being connected to the proximal end of the strapping member, wherein the flat hook member comprises;

i) an upper flat portion spaced away but extending over and parallel to the planar coupling, connected at a distal end to the proximal end of the strapping member, ii) a planar rubber member covering an upper surface and lower surface of the upper flat portion, the planar rubber member having planar outer surface which are each parallel to the upper flat portion and the planar coupling plate, c) a coupler member attached to the distal end of the strapping configured for releasable attachment to at least one of a chair and stool.

2. The drum restraining apparatus of claim 1 wherein the coupler member comprises a hook attached to the distal end of the strapping member.

3. The drum restraining apparatus of claim 1 the planar coupling plate has a slot adjacent the distal end and the strapping member is connect to the planar coupling member by passing through the slot to then connect to itself.

4. The drum restraining apparatus of claim 3 wherein the coupler member comprises a hook attached to the distal end of the strapping member.

5. The drum restraining apparatus of claim 3 wherein the planar coupling plate has a top surface with a portion covered by one of a hook and loop fastener.

6. The drum restraining apparatus of claim 5 wherein the coupler member comprises a hook attached to the distal end of the strapping member.

7. The drum restraining apparatus of claim 6 wherein the strapping member has an adjustable length.

8. The drum restraining apparatus of claim 6 wherein the strapping member has 2 portion connection by a releasable coupling formed by mating snap connectors.

* * * * *